US006289813B1

(12) United States Patent
Duguet et al.

(10) Patent No.: US 6,289,813 B1
(45) Date of Patent: Sep. 18, 2001

(54) ELECTROPYROTECHNIC IGNITER WITH ENHANCED IGNITION RELIABILITY

(75) Inventors: Jean-Rene Duguet, Survilliers; Nicolas Martin, Champs sur Marne, both of (FR)

(73) Assignee: LIVBAG SNC, Vert le Petit (FR)

( * ) Notice: Subject to any disclaimer, the term of this patent is extended or adjusted under 35 U.S.C. 154(b) by 0 days.

(21) Appl. No.: 09/505,169

(22) Filed: Feb. 17, 2000

(30) Foreign Application Priority Data

Feb. 18, 1999 (FR) ..... 99 01950

(51) Int. Cl.[7] ..... F42C 19/12

(52) U.S. Cl. ..... 102/202.5; 102/202.7; 102/202.9; 102/202.14

(58) Field of Search ..... 102/202.5, 202.7, 102/202.9, 202.14

(56) References Cited

U.S. PATENT DOCUMENTS

| | | | |
|---|---|---|---|
| 3,366,055 | | 1/1968 | Hollander, Jr. . |
| 3,572,247 | | 3/1971 | Warshall . |
| 4,103,619 | * | 8/1978 | Fletcher et al. . |
| 4,517,895 | | 5/1985 | Rucker . |
| 4,690,056 | | 9/1987 | Brede et al. . |
| 4,729,315 | | 3/1988 | Proffit et al. . |
| 4,959,011 | | 9/1990 | Nilsson . |
| 5,099,762 | | 3/1992 | Drapala . |
| 5,140,906 | * | 8/1992 | Little, II . |
| 5,431,101 | * | 7/1995 | Arrell, Jr. et al. . |
| 5,544,585 | * | 8/1996 | Duguet . |
| 5,565,651 | | 10/1996 | Kim et al. . |
| 5,576,509 | * | 11/1996 | Refouvelet et al. . |
| 5,616,881 | * | 4/1997 | Hansen . |
| 5,732,634 | | 3/1998 | Flickinger et al. . |
| 5,798,476 | * | 8/1998 | Bailey . |
| 6,158,347 | * | 12/2000 | Neyer et al. . |
| 6,178,888 | * | 1/2001 | Neyer et al. . |

FOREIGN PATENT DOCUMENTS

| | | | |
|---|---|---|---|
| 0 704 415 A1 | | 4/1986 | (EP) . |
| 0 334 725 | | 9/1989 | (EP) . |
| 0 745 519 A1 | | 12/1996 | (EP) . |
| 0 802 092 A1 | | 10/1997 | (EP) . |
| 0802092-A1 | * | 10/1997 | (EP) . |
| 98/39615 | | 9/1998 | (WO) . |

* cited by examiner

*Primary Examiner*—Charles T. Jordan
*Assistant Examiner*—Troy Chambers
(74) *Attorney, Agent, or Firm*—Pillsbury Winthrop LLP

(57) ABSTRACT

The present invention relates to the field of pyrotechnic igniters, especially those intended for motor-vehicle safety.

The igniters (1) according to the invention have a thin-film resistive bridge (19) connected via two thin metal areas (17 and 18) to two electrodes (9 and 10).

An initiating lacquer (20) covers the resistive bridge (19) and a varistor attached to the said areas protects the igniter from electrostatic discharges. The resistive bridge (19) has a volume resistivity of between $0.5\times10^6$ and $2\times10^6$ Ω.m and the initiating lacquer is made from a primary explosive.

The igniters (1) have a no-fire current of greater than 500 mA and an all-fire current of less than 1200 mA.

10 Claims, 2 Drawing Sheets

ELECTROPYROTECHNIC IGNITER WITH ENHANCED IGNITION RELIABILITY

The present invention relates to the field of electropyrotechnic igniters intended for motor-vehicle safety and especially to that of igniters intended for initiating seat-belt retractors or pyrotechnic gas generators for airbags. The invention relates more particularly to igniters whose heating system is formed by a thin-film resistive bridge connected to two conducting metal areas.

Conventionally, electropyrotechnic igniters intended for motor-vehicle safety are formed by an insulating body which is extended by a fragmentable metal body and through which two electrodes pass. The electrodes are connected together by a resistive heating filament surrounded by an explosive initiating composition, for example a composition based on lead trinitroresorcinate. Such igniters, which are described for example in U.S. Pat. Nos. 3,572,247; 4,517,895; 4,959,011; and 5,099,762, have the drawback, however, of being sensitive to the vibrations of the motor vehicle at the soldered joints between the resistive filament and the electrodes. These soldered joints when repeatedly stressed by the vibrations of the vehicle can break the igniter and make it inoperable.

In order to remedy this drawback, igniters have therefore been developed in which the electrodes are in contact with two separate conducting metal areas extending over the surface of the insulating body which is inside the metal cap. These two areas are connected together by a thin flat resistive strip deposited on the surface of the insulating body. The conducting areas and the resistive strip are covered with an explosive initiating composition. Such igniters, which are described for example in U.S. Pat. Nos. 5,554,585, 4,690,056 and 5,732,634, are no longer sensitive to the vibrations of the motor vehicle.

Moreover, electropyrotechnic igniters are characterized by two values: the "all-fire" current and the "no-fire" current.

The "all-fire" current corresponds to the limiting strength of an electric current above which it is certain that all the igniters of one batch will operate.

The "all-fire" currents demanded by motor-vehicle manufacturers are at the present time 800 mA or 1200 mA.

The "no-fire" current corresponds to the limiting strength of an electric current below which it is certain that no igniter of a batch will operate. The "no-fire" currents demanded by motor-vehicle manufacturers are at the present time 200 mA or 250 mA.

However, motor-vehicle manufacturers are increasingly desirous of being able to have electropyrotechnic igniters guaranteeing a no-fire current of at least 400 mA with an all-fire current close to 1200 mA. Although drilling detonators are found which satisfy one or other of these conditions, like those described, for example, in Application WO 98/39615, at the present time there are no electropyrotechnic igniters which satisfy both the abovementioned conditions at the same time and which are compatible with the operating times required by motor-vehicle safety.

The object of the present invention is specifically to provide such a pyrotechnic igniter.

The invention therefore relates to an electropyrotechnic igniter comprising, inside a metal container which is closed and held by an overmoulding compound, an initiation head consisting of a gas-tight wall having an upper face and consisting of a solid body, the axial part of which is composed of a glass cylinder through which two electrodes in the form of pins pass, one of the said electrodes being electrically connected to the solid body directly by a soldered joint or by means of a metal contact, the said electrodes having one end extending beyond the said upper face of the said gas-tight wall, this extension allowing them to be electrically connected to a flat printed circuit carried by a substrate, the said electrodes passing through the said substrate itself, the said igniter also including a flat resistive heating element placed on the said insulating substrate and connected to the said electrodes via two separate conducting metal areas extending over the said substrate, each area being in contact with one of the two electrodes, the said flat element and the said metal areas being covered with a pyrotechnic initiating composition, characterized in that:

(i) the said flat element has a thickness of less than or equal to 0.001 mm and is composed of a metal compound whose volume resistivity is between $0.5\times10^6$ Ωm and $2\times10^6$ Ωm;

(ii) the said pyrotechnic initiating composition is composed of a lacquer made from a polyvinyl binder and of a primary explosive;

(iii) a varistor, composed of an assembly of thin layers, is attached to the said conducting metal areas.

The invention relates more particularly to an electropyrotechnic igniter as defined above and comprising a cylindrical igniter body which has two plane faces and through which two electrodes pass, the said electrodes being able to be connected to a source of electric current, the said igniter body being surmounted by a fragmentable cap containing an ignition charge, the said cap and the said igniter body being held firmly together by an overmoulding compound, the plane face of the igniter body, lying inside the said cap, being covered with an insulating printed-circuit substrate, the said electrodes passing through the said substrate itself, the said igniter also including a flat resistive heating element deposited on the said insulating substrate and connected to the said electrodes via two separate conducting metal areas extending over the said substrate, each area being in contact with one of the two electrodes, and the said flat element and the said metal areas being covered with a pyrotechnic initiating composition, characterized in that:

(i) the said flat element has a thickness of less than or equal to 0.001 mm and is composed of a metal compound whose volume resistivity is between $0.5\times10^6$ Ωm and $2\times10^6$ Ωm;

(ii) the said pyrotechnic initiating composition is composed of a lacquer made from a polyvinyl binder and of a primary explosive;

(iii) a varistor, composed of an assembly of thin layers, is attached to the said conducting metal areas.

Compared with igniters operating with a thin-film bridge, the igniter according to the invention has three novel characteristics:

the thin-film resistive bridge has a very high volume resistivity;

the initiating composition makes use of a primary explosive which excludes any oxidation-reduction mixture as is frequently the case;

the varistor is deposited on the conducting metal areas inside the ignition head and is not placed inside the igniter body, as described for example in Patents EP 0,802,092 and U.S. Pat. No. 5,616,881.

The primary explosive used for making the initiating composition may be a conventional explosive, such as lead trinitroresorcinate, but, according to a first preferred embodiment of the invention, it will advantageously be composed of an alkali-metal salt of dinitrobenzofuroxan, and especially of rubidium dinitrobenzofuroxane. In this case, the binder will advantageously be polyvinyl chloride acetate.

According to a second preferred embodiment of the invention, the metal compound forming the flat resistive heating element is chosen from the group formed by bismuth, tantalum nitride, alloys based on iron and copper, and binary and terniary alloys based on nickel, chromium and phosphorus.

Advantageously, the varistor will have a jump-start voltage of between 5.5 and 17 volts for a peak current of greater than 100 amps (time: 8 to 20 microseconds).

The igniters according to the invention thus make it possible, by suitable sizing of their components, to reliably guarantee a no-fire current value of greater than 500 mA and an all-fire current value of less than or equal to 1200 mA.

These igniters, which have a high level of ignition reliability, find a preferred application in the pyrotechnic gas generators intended for activating safety devices for the occupants of a motor vehicle, such as airbags or seat-belt retractors.

A detailed description of a preferred embodiment of the invention is given below with reference to FIGS. 1 and 2.

Figure 1:
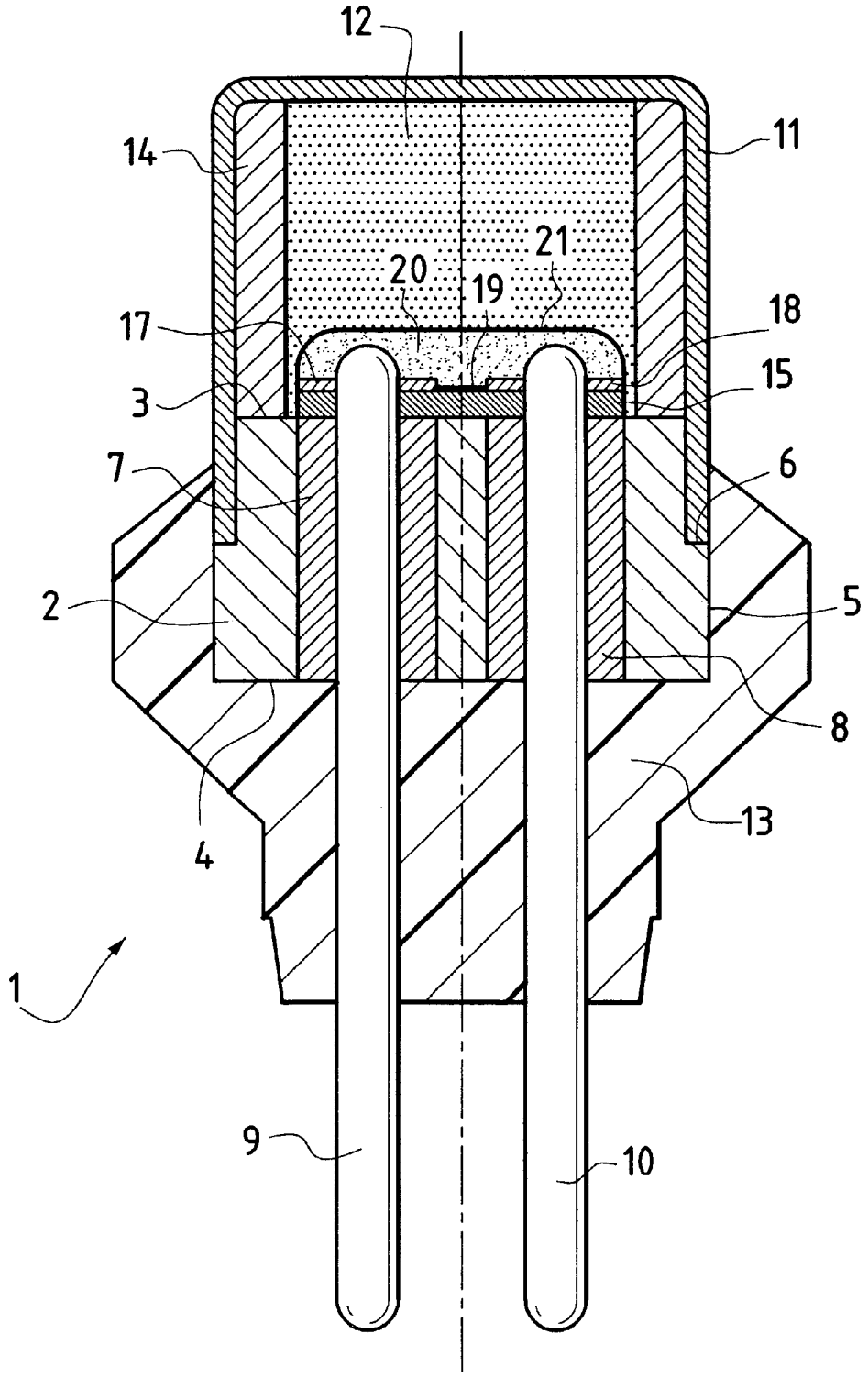
FIG. 1 shows, in axial cross section, an igniter according to the invention.

The electropyrotechnic igniter 1 shown in FIG. 1 is constructed from an igniter body 2. This igniter body 2 has the shape of a cylinder of revolution having a plane upper face 3 and a plane lower face 4, as well as a side wall 5 having an external circular shoulder 6. Penetrating over the entire height of the body 2 are two axial glass sheaths 7 and 8 in which two conducting electrodes 9 and 10 are placed, each electrode having a length greater than the height of the body 2. The electrodes are placed so as to extend slightly beyond the plane face 3 of the body 2 and to be extended well below the plane face 4 of the body 2.

The igniter body 2 is surmounted by a cylindrical fragmentable cap 11 which bears on the shoulder 6. The fragmentable cap 11 is preferably an aluminium cap. This cap 11 contains a pyrotechnic ignition charge 12 and is held firmly attached to the body 2 by an insulating overmoulding compound 13, for example an epoxy resin overmoulding compound. The ignition charge 12 is advantageously composed of a powder based on boron and potassium nitrate and can be supported by a hollow cylindrical skirt 14 placed inside the cap 11. This skirt 14 may be a metal skirt or a plastic skirt. The overmoulding compound 13 leaves the lower ends of the electrodes 9 and 10 free, so that the latter can be connected a source of electric current.

The plane face 3 of the igniter body 2 lying inside the cap 11 is covered with an insulating printed-circuit substrate through which the electrodes 9 and 10 also pass. This insulating substrate 15 has the shape of a discoid plate and will preferably be made of a material which is not a good electrical conductor but is a good heat conductor, such as alumina or silicone.

Figure 2:
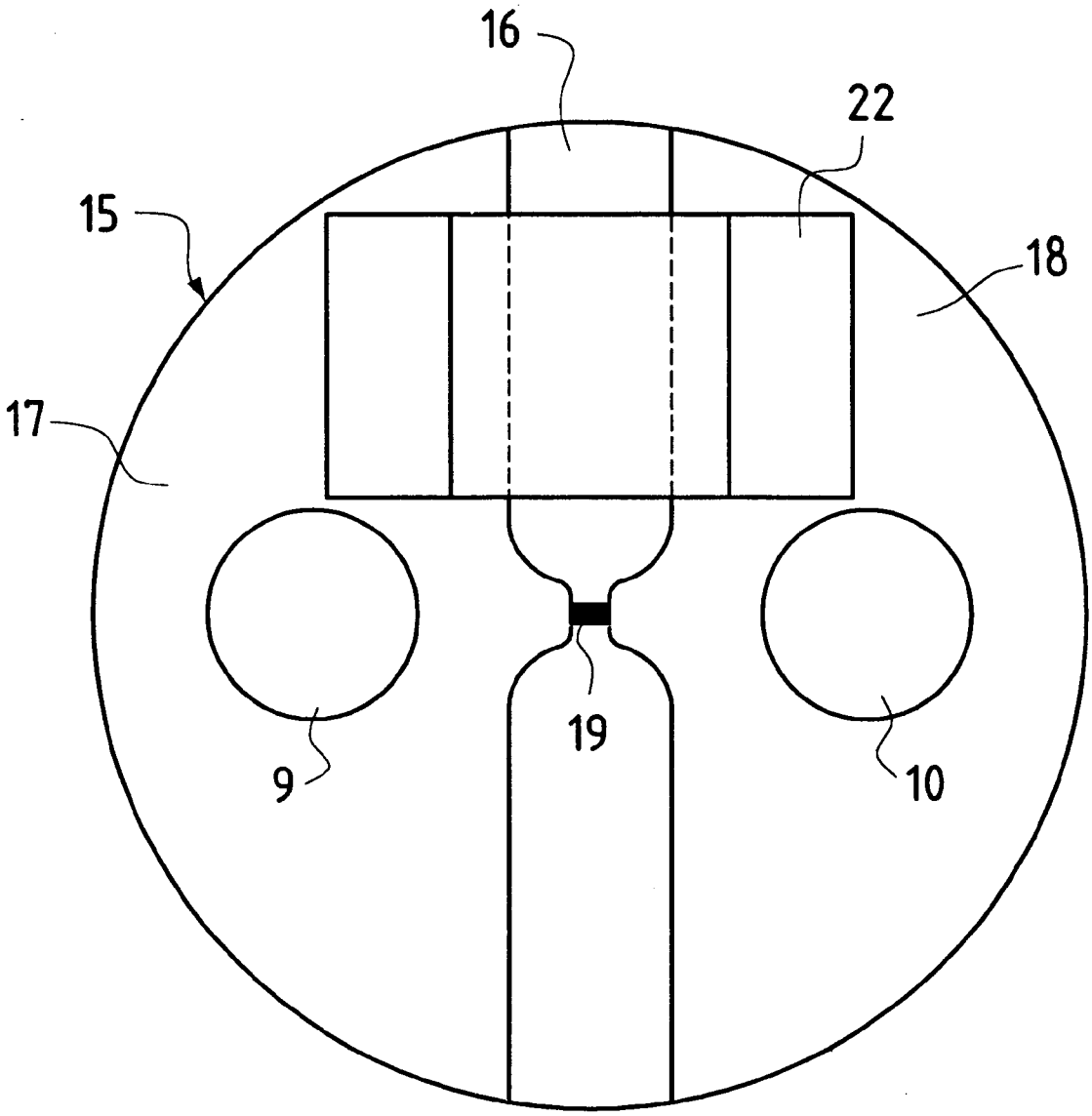
FIG. 2 shows, seen from above, the insulating printed-circuit substrate placed inside the igniter shown in FIG. 1.

It is on this insulating substrate 15 that the initiation device is placed, which device constitutes the core of the invention and is now described more particularly with reference to FIG. 2.

The upper face 16 of the insulating substrate 15 is covered with two separate and non-touching metal areas 17 and 18, each area being penetrated by one 9 or 10 of the two electrodes and soldered to the upper surface of the said area.

The areas 17 and 18 have the general shape of a segment of a circle and are made of copper, generally have a thickness of about 35 micrometers.

The areas 17 and 18 are connected together by a flat resistive heating element 19 which is deposited on the said insulating substrate 15.

According to a first essential characteristic of the invention, this flat element has a thickness of less than or equal to 1 micrometer, often about 0.5 micrometers, and is made of a metal compound whose volume resistivity is between $0.5\times10^6$ and $2\times10^6$ Ohm.meters. This metal compound is preferably chosen from the group formed by bismuth, tantalum nitride, alloys based on iron and copper, and binary and terniary alloys based on nickel, chromium and phosphorus. It has been found that tantalum nitride is particularly suitable.

According to a second essential characteristic of the invention, the said flat element 19 and the said conducting areas 17 and 18 are covered with a pyrotechnic initiating composition 20 formed by a lacquer made from a polyvinyl binder and from a primary explosive. Preferably, this primary explosive will be formed by an alkali-metal salt of dinitrobenzofuroxan, namely rubidium dinitrobenzofuroxane, advantageously, polyvinyl chloride acetate will be used as a binder. The initiating composition 20 may be protected from direct contact with the ignition charge 12 by a combustible film 21, for example a film of "nitrofilm".

Finally, according to a third essential characteristic of the invention, a varistor 22 composed of an assembly of thin layers, for example thin layers of zinc oxide, is attached to the conducting areas 17 and 18 in order to protect the igniter 1 from high-voltage electrostatic discharges. This varistor 22, which is put into place before the initiating composition 20 is deposited, will advantageously have a cut-out voltage of between 5.5 and 17 volts for a peak current of greater than 100 amps (time: 8–20 microseconds).

By correctly sizing the components, the invention thus makes it possible to manufacture pyrotechnic igniters having a no-fire current value of greater than 500 mA and an all-fire current value of less than 1200 mA.

EXAMPLE

Batches of igniters according to the one that has just been described and is shown in FIGS. 1 and 2 were manufactured. These igniters had the following characteristics and gave the following results.

| Batch No. | No-fire current (+105° C.); 99.9999% reliability | All-fire current (−40° C.); 99.9999% reliability | Operating time (milliseconds) |
|---|---|---|---|
| 1 | 529 mA | 1101 mA | 0.629 |
| 2 | 559 mA | 1046 mA | 0.678 |
| 3 | 560 mA | 1071 mA | 0.714 |

These igniters withstand, without any deterioration, 4000 electrostatic discharges coming from a 150 picofarad capacitor charged to 25 kilovolts with a 150 ohm series resistor.

In addition, they withstand mechanical impacts of more than 2000 g and extreme thermal shocks ranging from −650° C. to +125° C.

What is claimed is:

1. Electropyrotechnic igniter (1) comprising, inside a metal container (11) which is closed and held by an overmoulding compound (13), an initiation head consisting of a gas-tight wall (2) having an upper face (3) and consisting of a solid body (5), the axial part of which is composed of a glass cylinder (7) through which two electrodes (9, 10) in the form of pins pass, one of the said electrodes being electrically connected to the solid body (5), the said electrodes (9, 10) having one end extending beyond the upper face (3) of the said gas-tight wall (2), this extension allowing them to be electrically connected to a flat printed circuit carried by a substrate (15), the said electrodes passing through the said substrate (15) itself, the said igniter (1) also including a flat resistive heating element (19) placed on the said insulating substrate (15) and connected to the said electrodes (9, 10) via two separate conducting metal areas (17, 18) extending over the said substrate, each area being in contact with one of the two electrodes, the said flat element (19) and the said metal areas (17, 18) being covered with a pyrotechnic initiating composition (20), characterized in that:

(i) the said flat element has a thickness of less than or equal to 0.001 mm and is composed of a metal compound whose volume resistivity is between $0.5\times10^6$ Ωm and $2\times10^6$ Ωm;

(ii) the said pyrotechnic initiating composition is composed of a lacquer made from a polyvinyl binder and of a primary explosive;

(iii) a varistor (22), composed of an assembly of thin layers, is attached to the said areas.

2. Electropyrotechnic igniter (1), comprising a cylindrical igniter body (2) which has two plane faces (3, 4) and through which two electrodes (9, 10) pass, the said electrodes being able to be connected to a source of electric current, the said igniter body being surmounted by a fragmentable cap (11) containing an ignition charge (12), the said cap and the said igniter body being held firmly together by an overmoulding compound (13), the plane face (3) of the igniter body (2), lying inside the said cap, being covered with an insulating printed-circuit substrate (15), the said electrodes passing through the said substrate (15) itself, the said igniter (1) also including a flat resistive heating element (19) deposited on the said insulating substrate (15) and connected to the said electrodes (9, 10) via two separate conducting metal areas (17, 18) extending over the said substrate, each area being in contact with one of the two electrodes, and the said flat element and the said metal areas (17, 18) being covered with a pyrotechnic initiating composition (20), characterized in that:

(i) the said flat element has a thickness of less than or equal to 0.001 mm and is composed of a metal compound whose volume resistivity is between $0.5\times10^6$ Ωm and $2\times10^6$ Ωm;

(ii) the said pyrotechnic initiating composition is composed of a lacquer made from a polyvinyl binder and of a primary explosive;

(iii) a varistor (22), composed of an assembly of thin layers, is attached to the said areas.

3. Igniter according to claim 2, characterized in that the primary explosive is composed of an alkali-metal salt of dinitrobenzofuroxan.

4. Igniter according to claim 3, characterized in that the primary explosive is composed of rubidium dinitrobenzofuroxane.

5. Igniter according to claim 2, characterized in that the said binder is polyvinyl chloride acetate.

6. Igniter according to claim 2, characterized in that the said metal compound is chosen from the group composed of bismuth, tantalum nitride, alloys based on iron and copper, and binary and terniary alloys based on nickel, chromium and phosphorus.

7. Igniter according to claim 2, characterized in that the said varistor has a switch voltage of between 5.5 volts and 17 volts for a peak current greater than 100 amps.

8. Igniter according to claim 2, characterized in that it has a non-fire current value of greater than 500 mA.

9. Igniter according to claim 2, characterized in that it has an all-fire current value of less than 1200 mA.

10. Igniter according to claim 2, characterized in that the said insulating substrate (15) is composed of a material chosen from the group formed by alumina and silicone.

* * * * *